US007705526B2

(12) United States Patent
Lee et al.

(10) Patent No.: US 7,705,526 B2
(45) Date of Patent: Apr. 27, 2010

(54) LAMP WITH TWISTED FILAMENT STRUCTURE

(75) Inventors: Young Jun Lee, Seoul (KR); Yang Kyeong Kim, Bucheon-si (KR); Wan Soo Kim, Gwangmyeong-si (KR)

(73) Assignee: LG Electronics Inc., Seoul (KR)

( * ) Notice: Subject to any disclaimer, the term of this patent is extended or adjusted under 35 U.S.C. 154(b) by 570 days.

(21) Appl. No.: 11/240,350

(22) Filed: Oct. 3, 2005

(65) Prior Publication Data

US 2006/0186807 A1 Aug. 24, 2006

(30) Foreign Application Priority Data

Feb. 18, 2005 (KR) ..... 10-2005-0013666

(51) Int. Cl.
*H01J 1/88* (2006.01)
*H01J 19/42* (2006.01)

(52) U.S. Cl. ..... 313/273; 313/631; 313/493; 313/574; 313/623; 313/491

(58) Field of Classification Search ..... 313/491, 313/493, 573–574, 623, 628, 631, 634, 318.01, 313/271–273
See application file for complete search history.

(56) References Cited

U.S. PATENT DOCUMENTS

| | | | | |
|---|---|---|---|---|
| 2,410,993 A | | 11/1946 | Nelson et al. | |
| 4,017,758 A | | 4/1977 | Almer et al. | |
| 4,427,919 A | * | 1/1984 | Grenfell | 313/546 |
| 4,584,502 A | * | 4/1986 | Kiesling et al. | 315/64 |
| 4,959,585 A | * | 9/1990 | Hoegler et al. | 313/271 |
| 6,075,313 A | | 6/2000 | Verheyen | |
| 2004/0051436 A1 | * | 3/2004 | Kawai | 313/346 DC |

FOREIGN PATENT DOCUMENTS

| | | | |
|---|---|---|---|
| BE | 876668 | A | 11/1979 |
| DE | 40 21 709 | A1 | 1/1992 |
| GB | 10071 | A | 4/1908 |
| GB | 116134 | A | 5/1918 |
| GB | 318933 | A | 12/1930 |
| GB | 409953 | A | 5/1934 |
| GB | 567220 | A | 2/1945 |
| GB | 760609 | A | 11/1956 |
| GB | 1191247 | A | 5/1970 |
| GB | 1 212 329 | A | 11/1970 |
| GB | 1 241 196 | A | 7/1971 |
| GB | 1 246 181 | A | 9/1971 |
| GB | 1 261 272 | A | 1/1972 |
| JP | 07-169387 | A | 7/1995 |
| JP | 2001-076847 | A | 3/2001 |
| JP | 2003-7254 | A | 1/2003 |
| JP | 2004-273234 | A | 9/2004 |

* cited by examiner

*Primary Examiner*—Karabi Guharay
*Assistant Examiner*—Kevin Quarterman
(74) *Attorney, Agent, or Firm*—Birch, Stewart, Kolasch & Birch, LLP

(57) ABSTRACT

A lamp including a hermetic tube and a filament configured to radiate thermal energy within the tube. Further, the filament extends along a length direction of the tube and is spaced apart from an inner wall of the tube.

26 Claims, 3 Drawing Sheets

LAMP WITH TWISTED FILAMENT STRUCTURE

CROSS REFERENCE TO A RELATED APPLICATION

This application claims the benefit of the Korean Patent Application No. P2005-0013666, filed on Feb. 18, 2005, which is hereby incorporated by reference in its entirety.

BACKGROUND OF THE INVENTION

1. Field of the Invention

The present invention relates to a lamp, and more particularly to a lamp that radiates high-temperature thermal energy.

2. Discussion of the Related Art

Generally, a lamp radiates light using a heated filament. Further, if the filament is heated at a high temperature, the lamp is capable of heating, drying, melting and hardening a prescribed object using the radiated heat and light from the lamp.

Such a lamp includes of a hermetic tube and a filament provided within the tube. The filament is for radiating light and high-temperature heat. In addition, the tube can be charged with an inert gas or can be set in a vacuum state. The inert gas or the vacuum state minimizes the evaporation of the filament due to the emission of electrons. Further, the tube is made of quartz glass that can withstand a high temperature.

In addition, the quartz glass is thermally treated to withstand a temperature of about 1,270K. The filament is also wound into a spiral shape in a length direction of the tube to provide a wide radiation area for effectively radiating high temperature heat.

However, the above-explained related art lamp has the following problems.

The spirally-wound filament tends to sag due to its own weight and thus contacts an inside of the tube. Therefore, because the spirally-wound filament contacts the hermetic tube, the filament is not allowed to radiate heat exceeding a temperature (about 1,270K) that would melt or transform the quartz glass tube. For this reason, the thermal energy radiation of the lamp is lowered. Specifically, according to the Stefan-Boltzmann Law of $E \infty T^4$ (E: radiant energy, T: absolute temperature), if the absolute temperature drops, the thermal energy radiation is considerably lowered. Hence, the related art lamp is not suitable for a high-temperature drying or heating function.

Moreover, as the filament is brought into contact with the tube, a temperature difference between a contact portion and non-contact portion of the filament is considerably large. Therefore, the chance of the filament breaking is increased.

Further, because the filament has a spiral shape, a length of the straightened filament is at least 1.5 times greater than that of the spirally-wound filament. Hence, the larger length of the filament substantially raises the cost of the filament. Also, because the manufacturing and assembling processes of the spirally-wound filament are complicated, productivity is lowered. It is also highly probable that the tube or filament may be broken in the assembling process.

SUMMARY OF THE INVENTION

Accordingly, one object of the present invention is to provide a novel lamp that substantially obviates one or more problems due to limitations and disadvantages of the related art.

Another object of the present invention is to provide a lamp with enhanced thermal energy radiation capabilities.

Yet, another object of the present invention is to provide a lamp that can be produced more efficiently and at a lower cost.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, the present invention provides a novel lamp including a hermetic tube and a filament configured to radiate thermal energy within the tube. The filament extends along a length direction of the tube and is spaced apart from an inside of the tube.

Preferably, the filament is twisted centering on a central axis of the filament, a tension is applied to the filament in a direction of the filament, and a length of the twisted filament is substantially equal to a length of the filament untwisted.

The filament may also preferably include a strap. More preferably, the filament includes a fabric strap of a plurality of woven wires. The filament may have a rectangular cross-section, an 'X' type cross-section, or a 'V' type cross-section. Alternatively, the filament may include at least two wires extending in a direction of the tube.

The lamp also preferably includes leads connected to both ends of the filament, which are used to supply electricity to the filament. The leads are also configured to support the filament so the filament doesn't untwist. For example, at least two leads may be provided to each end of the filament and be spaced apart from the central axis of the filament. The leads at each end of the filament are also preferably parallel to the central axis of the filament. Moreover, the leads are preferably configured to apply a tensile force to the filament. Also, each lead may include a spring portion.

Preferably, the lamp further includes a holder inserted between the filament and each of the leads. The holder is configured to hold the filament. The lamp further preferably includes caps provided at both ends of the tube to hermetically seal the tube. Also, the holder may have a heat expansion coefficient similar to that of the filament, and the cap may have a heat expansion coefficient similar to that of the tube.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
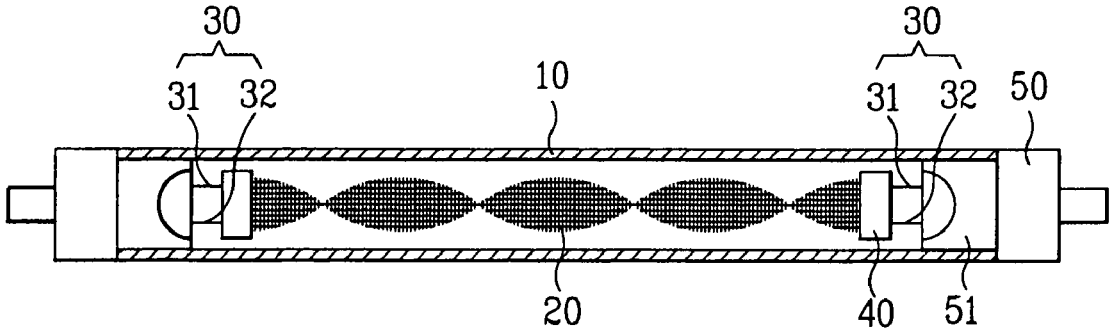
FIG. 1 is a cross-sectional diagram of a lamp according to the present invention.

FIG. 1 is a cross-sectional diagram of a lamp according to the present invention. As shown, the lamp includes a hermetic tube 10 and a filament 20 provided within the tube 10. Further, the filament 20 extends in a length direction of the tube 10.

In addition, the tube 10 is charged with an inert gas or is set in a vacuum state. The inert gas or the vacuum state minimizes the evaporation of the filament caused by the emission of electrons. Also, the tube 10 may be made of a quartz glass that can withstand a high temperature, and may also be thermally treated to withstand temperatures of about 1,270K, for example. Optionally, a fluorescent layer can be coated on an inside of the tube 10 so the lamp evenly radiates light.

The filament 20, which is supplied with electricity and thus is heated at a high temperature, is configured to radiate a substantial amount of thermal energy as well as light energy. Therefore, the filament includes a material that can be electrically heated.

In addition, as shown in FIG. 1, the filament 20 is arranged to be separated from the inner side of the tube 10. Due to such an arrangement, even if the filament 20 is heated over a temperature that the tube 10 can withstand, e.g., over 1,450K, the tube 10 is not melted or transformed. Hence, because the filament 20 is allowed to be heated at a temperature higher than that for the related art filament, the thermal energy radiation of the lamp can be substantially increased.

Moreover, because the filament 20 does not contact the tube 10, the filament 20 can be evenly heated. Therefore, the filament 20 is less likely to break due to an uneven temperature difference.

In addition, the filament 20 installed within the tube 10 is preferably applied with tension in the length direction of the tube and filament. The applied tension stretches the filament 20 so as to prevent the filament 20 from sagging down because of its weight. The tension also prevents the filament 20 from fluctuating when a shock or vibration is applied to the lamp. Hence, the tension applied to the filament 20 prevents the filament 20 from being brought into contact with the tube 10, and therefore the lamp can stably radiate a large amount of thermal energy. In one example, the tension is preferably set proportional to a length of the filament 20. In another example, the tension is preferably set proportional to a weight or thickness of the filament 20.

Also, as shown in FIG. 1, the filament 20 is preferably twisted centering on a central axis of the filament 20. Such a configuration of the filament 20 can be achieved by twisting both ends of the filament 20 in opposite directions. In addition, the twisted filament 20 preferably has uniform radiation areas in all directions, whereby the lamp can effectively radiate thermal energy.

As shown in FIG. 1, the twisted filament 20 of the present invention preferably has a small volume to avoid the filament 20 from being brought into contact with the tube 10. This differs from the related art spiral type filament, which has a much larger volume.

Moreover, because the related art spiral filament is vulnerable to transformation in its length direction, it is impossible to apply tension to the related art filament. In contrast, the twisted filament 20 of the present invention is difficult to transform in its length direction, whereby a prescribed tension can be applied to the filament 20 to prevent the filament 20 from contacting the tube 10. Hence, the twisted filament 20 is advantageous because it stays separated from an inner side of the tube 10 and also has a uniform radiation area.

In addition, as shown in FIG. 1, the twisted filament 20 may include a strap, such as a fabric strap formed of a plurality of woven wires. The filament 20 may also include, for example, a signal strap or at least two stacked straps.

Figure 2A:
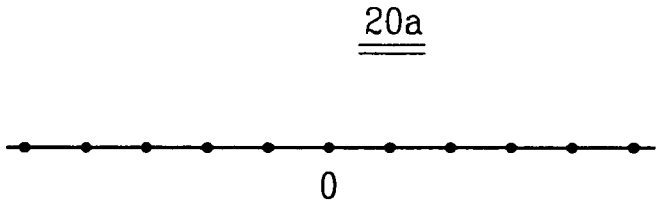
FIG. 2A is a cross-sectional diagram of a filament in FIG. 1.

Further, even though the filament my appear to have a line shape because of its small thickness, the filament 20, as shown in FIG. 2A, has a substantially rectangular cross-section 20*a* taken along its lateral direction, i.e., its width direction. That is, FIG. 1 shows the filament 20*a* formed by twisting the strap to have the rectangular cross-section 20*a* as shown in FIG. 2A.

Figure 2B:
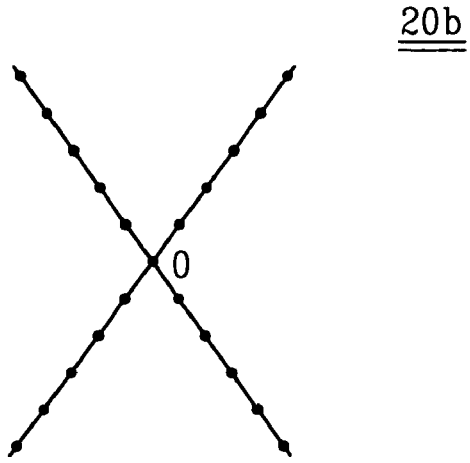
FIG. 2B and FIG. 2C are cross-sectional diagrams of filaments modified from the filament in FIG. 1.

Alternatively, as shown in FIG. 2B, the strap filament 20 may have an 'X' type cross-section 20*b*. Because the 'X' type cross-section increases a radiation area, the filament 20 in this example has a radiation greater than that of a general filament at the same filament temperature. Moreover, the 'X' type cross-section 20*b* of the FIG. 2B is substantially symmetric at its center O similar to the rectangular cross-section 20*a* of FIG. 2A. Furthermore, the cross-section 20*b* is symmetric in all directions and therefore the filament 20 having such a cross-section 20*b* can evenly and effectively radiate thermal energy in all directions.

Figure 2C:
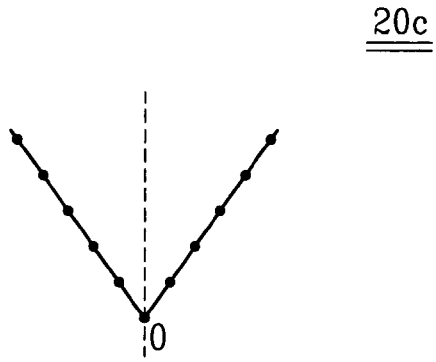

As yet another example, the strap filament 20 may have a 'V' type cross-section 20*c*, which is shown in FIG. 2C. In this example, the amount of radiation is smaller than that of the filament having the 'X' type cross-section in FIG. 2B, but the filament is easier to fabricate. Further, the cross-section 20*c* is symmetric to a vertical axis set at its center O, which is shown by a dotted line in FIG. 2C. Thus, the filament 20 having such a cross-section 20*c* can evenly and effectively radiate thermal energy in all directions.

Figure 3:
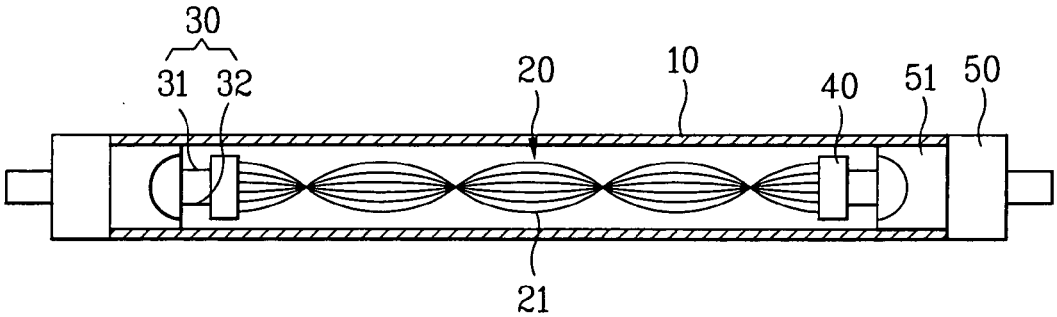
FIG. 3 is a cross-sectional diagram of a lamp including a filament according to another embodiment of the present invention.

Turning next to FIG. 3, which illustrates an alternative example in which the twisted filament 20 includes at least two wires 21 extending in a length direction of the tube 10. Further, the number of the wires 21 can be appropriately adjusted according to the required radiation.

In the above-explained embodiments in FIGS. 2A to 3, a length of the twisted filament 20 is substantially equal to that of the untwisted filament 20. On the other hand, the spirally wound filament of the related art has a length considerably smaller than that of the unwound filament. Therefore, the twisted filament according to the present invention advantageously uses a smaller quantity of material for providing a lamp. Hence, the cost of manufacturing the lamp is considerably lowered. Moreover, because twisting the filament is easier than spirally winding the filament, the filament productivity is raised and a breakage rate in fabricating the filament 20 or tube 10 is lowered according to the present invention.

FIGS. 1 and 3 also illustrate the lamp according to the present invention including leads 30 connected to both ends of the filament 20. The leads 30 are configured to be connected to an external power supply source (not shown) such that electricity may be supplied to the filament 20. Further, the leads 30 preferably support the filament 20 so it does not contact the tube 10. Thus, because the filament 20 is kept separated from the tube 10, the leads 30 perform an additional support mechanism function. This differs from the related art filament which contacts the inside of the tube, and thus does not have a separate support mechanism. The leads 30 are also preferably configured to support the twisted filament 20 such that the filament 20 does not untwist.

In addition, according to the present invention and as shown in FIGS. 1 and 3, the leads 30 include at least two leads 31 and 32 provided at each end of the filament 20 to stably support and prevent the filament from untwisting more so than when using a single lead. In addition, as shown, the leads 31 and 32 are preferably separated from each other along a central axis of the filament 20.

Also, to prevent the filament 20 from untwisting, the leads 31 and 32 may be arranged to hold the filament 20 so it doesn't untwist (i.e., in a direction opposite to the twisted direction of the filament). That is, the leads 31 and 32 are preferably configured to maintain a balance of the filament 20 against a counter torsional force (or moment) corresponding to a repulsive force generated from the twisted filament 20. Hence, it is preferable that each central axis of the leads 31 and 32 is parallel to the central axis of the filament 20. Namely, the leads 31 and 32 are preferably postured in the common plane to stably maintain the balance of the filament 20.

Figure 5A:
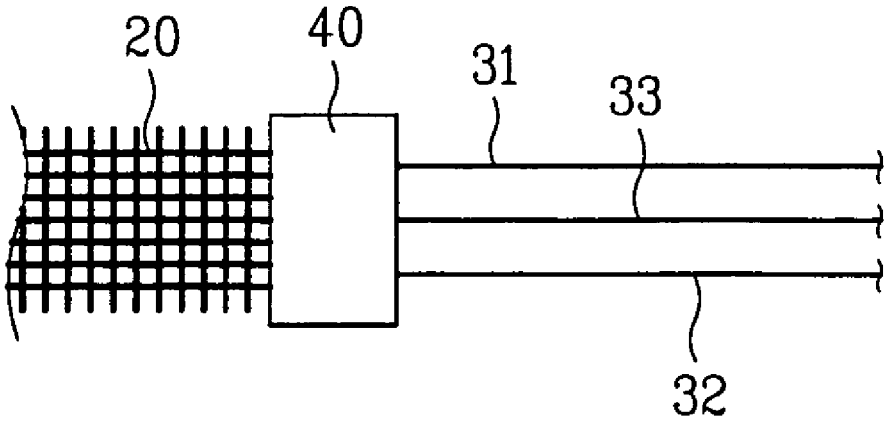
FIG. 5A and FIG. 5B are layouts of modifications of the support mechanism in FIG. 4, respectively.

More specifically, the leads 31 and 32 are spaced apart from the central axis of the filament 20 such that the first and second leads 31 and 32 stably support the filament 20. In addition, the first and second leads 31 and 32 are preferably symmetric about the central axis of the filament 20. Thus, each of the first and second leads 31 and 32 are substantially parallel to the central axis so the balance of the filament 20 is sustained and the filament 20 is prevented from untwisting. Moreover, as shown in FIG. 5A, each of the leads 30 may include a third lead 33 that extends along the central axis of the filament 20. Using three leads 31-33, the filament 20 is more stably supported and is prevented from untwisting.

Figure 4:
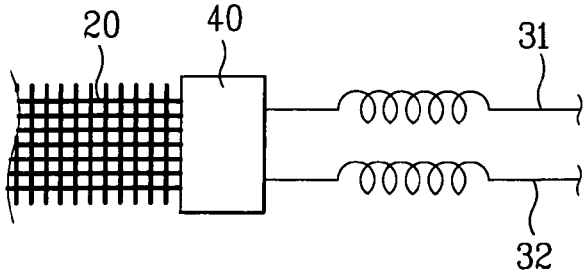
FIG. 4 is a layout of a filament support mechanism of a lamp according to the present invention.
Figure 5B:
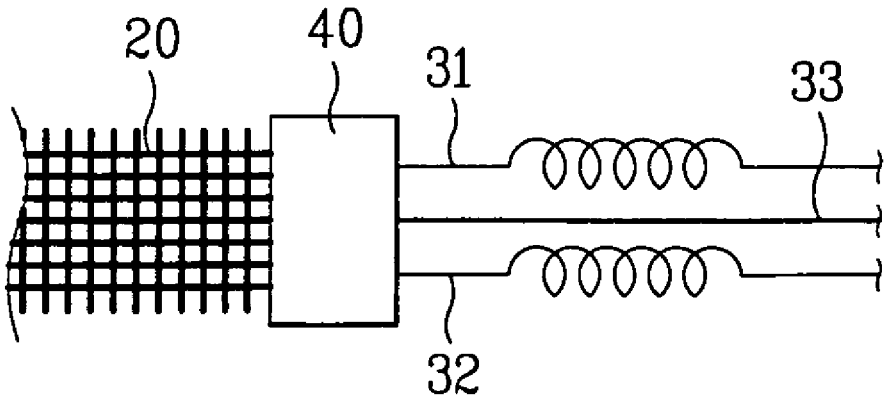

In addition, FIGS. 4 and 5B illustrate the leads 31 and 32 including springs so as to provide a tensile force (i.e., tension) to the filament 20. Note that although not shown in these figures, the third lead 33 may also include a spring. Further, the springs may be provided to the entire length of the leader or may be provided only to prescribed sections of the leads.

In addition, once the filament 20 is heated during an operation of the lamp, the filament naturally increases in length and tends to sag. However, according to the present invention, the springs provide a tensile force to the filament 20, which prevents the filament from sagging. Therefore, a space is maintained between the filament 20 and the tube 10.

In addition, the leads 30 may be directly connected to the filament 20 or a holder 40 (see FIGS. 3-5B) may be inserted between the filament 20 and the leads 30. Further, the holders 40 electrically and physically connect the leads 30 to the filament 20, and more specifically to both of the ends of the filament 20. Moreover, the holder 40 is configured to hold the filament 20 more tightly than the leads 30. Each holder 40 may also include a coil extending from a solid member of the leads 30 to hold the filament 20.

Further, as shown in FIGS. 1 and 3, the lamp further includes caps 50 provided to both ends of the tube 10 so as to hermitically seal the tube 10. As shown, each cap 50 includes an extension 51 extending into the tube 10 to thereby ensure a reliable seal. Terminals (not shown) are also provided within each cap 50 and extensions 51 to connect the leads 30 to an external power source. Hence, each lead 30 is connected to the cap 50, and more specifically to the extension 51 of the corresponding cap 50.

In addition, when a heat expansion coefficient of the filament 20 is considerably different from that of the holder 40, a coupling portion between the filament 20 and the holder 40 may be broken if the filament 20 is heated at a high temperature. Hence, it is preferable the holder 40 includes a metal having a heat expansion coefficient similar to that of the filament 20 such as nickel (Ni). Alternatively, the holder 40 may include another material having a heat expansion coefficient similar to that of the filament 20.

Further, the cap 50 including the extension 51 is preferably formed of Mo having a heat expansion coefficient similar to that of the tube 10. Alternatively, the cap 50 can be formed of another material having a heat expansion coefficient similar to that of the tube 10. Thus, the caps 50 and more particularly the extensions 51 are designed to prevent the tube 10 from breaking due to considerably different heat expansion coefficients.

Accordingly, the lamp of the present invention provides the following effects or advantages.

First of all, because the filament is spaced apart from the tube, the filament can be heated to a considerably high temperature to thereby raise the radiation. Hence, the lamp according to the present invention is also applicable to drying, heating, melting and hardening of a desired object. Moreover, by avoiding contact with the tube, the filament can be uniformly heated and is prevented from breaking due to a temperature difference of the filament.

Secondly, because the length of the stretched filament is substantially equal to that of the twisted filament, the cost of fabricating the filament can be remarkably reduced. Also, because the twisting process of the filament is easier, more filaments can be produced and the filaments are less likely to break.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A lamp comprising:

a hermetic tube; and a filament configured to radiate thermal energy within the tube, said filament extending along a length direction of the tube and being spaced apart from an inner wall of the tube, wherein the filament in a shape of a twisted strap including a plurality of longitudinally extending wires centering on a central axis of the filament such that outer surfaces of the filament form a succession of filament-shaped waves and a plurality of transverse wires extending between the plurality of longitudinally extending wires.

2. The lamp of claim 1, further comprising a tension mechanism configured to apply a tension to the filament in a direction of the filament.

3. The lamp of claim 2, wherein the tension mechanism comprises a spring attached to ends of the filament.

4. The lamp of claim 1, wherein the strap is a fabric strap including the plurality of woven wires.

5. The lamp of claim 1, wherein a cross-section of the filament is symmetric with respect to a center of the filament.

6. The lamp of claim 1, wherein the filament has a rectangular cross-section.

7. The lamp of claim 1, wherein the filament has an 'X' shape cross-section.

8. The lamp of claim 1, wherein a cross-section of the filament is symmetric with respect to a vertical axis set at a center of the filament.

9. The lamp of claim 1, wherein the filament has a 'V' shape cross-section.

10. The lamp of claim 1, wherein a length of the twisted filament is substantially equal to a length of an untwisted filament.

11. The lamp of claim 1, further comprising at least two leads connected to each end of the filament, said at least two leads configured to supply electricity to the filament.

12. The lamp of claim 11, wherein the at least two leads are further configured to prevent the filament from untwisting.

13. The lamp of claim 11, wherein the at least two of the leads are provided to each end of the filament.

14. The lamp of claim 11, wherein the at least two leads are spaced apart from a central axis of the filament.

15. The lamp of claim 13, wherein the at least two leads on each end of the filament are parallel to a central axis of the filament.

16. The lamp of claim 11, wherein each of the at least two leads comprises:

a first lead provided to each end of the filament and being spaced apart from a central axis of the filament; and a second lead provided to each end of the filament and being symmetric to the first lead with respect to the central axis of the filament.

17. The lamp of claim 16, wherein each of the at least two leads further comprises a third lead provided to each end of the filament, said third lead extending along the central axis of the filament.

18. The lamp of claim 11, wherein each of the at least two leads has a spring portion to provide a tensile force to the filament.

19. The lamp of claim 11, further comprising a holder inserted between the filament and each of the at least two leads, said holder being configured to hold the filament.

20. The lamp of claim 1, further comprising caps provided to each end of the tube so as to hermetically seal the tube.

21. The lamp of claim 19, wherein the holder has a heat expansion coefficient similar to that of the filament.

22. The lamp of claim 19, wherein the holder is formed of Ni.

23. The lamp of claim 20, wherein the cap has a heat expansion coefficient similar to that of the tube.

24. The lamp of claim 20, wherein the cap is formed of Mo.

25. The lamp of claim 1, wherein the succession of filament-shaped waves comprises sinusoidal-shaped waves.

26. The lamp of claim 1, wherein the succession of filament-shaped waves are symmetric with respect to each other via joining positions between adjacent filament-shaped waves.

* * * * *